US010969203B2

(12) United States Patent
Vega

(10) Patent No.: US 10,969,203 B2
(45) Date of Patent: Apr. 6, 2021

(54) ANTI-TERRORIST THREAT PROTECTION SYSTEM

(71) Applicant: Rogelio E Vega, Hollidaysburg, PA (US)

(72) Inventor: Rogelio E Vega, Hollidaysburg, PA (US)

( * ) Notice: Subject to any disclaimer, the term of this patent is extended or adjusted under 35 U.S.C. 154(b) by 58 days.

(21) Appl. No.: 16/401,702

(22) Filed: Jul. 15, 2019

(65) Prior Publication Data

US 2021/0018301 A1 Jan. 21, 2021

(51) Int. Cl.

| | |
|---|---|
| ***F41H 5/24*** | (2006.01) |
| ***F41H 9/02*** | (2006.01) |
| ***F41H 5/26*** | (2006.01) |
| ***F41H 5/02*** | (2006.01) |

(52) U.S. Cl.

CPC ..... *F41H 5/24* (2013.01); *F41H 5/26* (2013.01); *F41H 9/02* (2013.01); *F41H 5/02* (2013.01)

(58) Field of Classification Search

CPC ..... F41H 5/08; F41H 5/14; F41H 5/02; F41H 5/24; F41H 5/26; F41H 9/02

USPC ..... 89/36.02, 36.07, 36.09, 926, 929

See application file for complete search history.

(56) References Cited

U.S. PATENT DOCUMENTS

| | | | | | |
|---|---|---|---|---|---|
| 5,392,686 | A * | 2/1995 | Sankar | F41H 5/08 | 109/49.5 |
| 5,641,934 | A * | 6/1997 | Follett | F41H 5/0407 | 89/36.05 |
| 6,128,845 | A * | 10/2000 | Jacobson | A62C 99/0054 | 42/1.15 |
| 6,622,607 | B1 * | 9/2003 | Miller | F41H 5/06 | 2/2.5 |
| 10,247,509 | B1 * | 4/2019 | Sumners | F41B 11/723 | |
| 2003/0167911 | A1 * | 9/2003 | White | F41H 5/14 | 89/36.07 |
| 2009/0025546 | A1 * | 1/2009 | White | F41H 5/08 | 89/36.02 |
| 2012/0152096 | A1 * | 6/2012 | Peters | F41H 5/06 | 89/36.01 |
| 2016/0216080 | A1 * | 7/2016 | Gonda | F41H 5/14 | |
| 2020/0041232 | A1 * | 2/2020 | Feirrell | A47B 41/02 | |
| 2020/0064106 | A1 * | 2/2020 | Tervola | F41H 5/08 | |

* cited by examiner

*Primary Examiner* — Bret Hayes

(57) ABSTRACT

The invention includes a shelter, a piece of clear, bullet-resistant plastic, armor plates and a flaming projectile launcher. The shelter combines two panels of metal or wood, joined along one edge at a ninety degree angle but is also foldable. The clear plastic piece is installed in panel. One armor plate is held by a user, while several plates are embedded in the panels or piggy-backed together thereon. The launcher fires a flaming projectile at a lessened velocity by using fifty percent or less of the powder normally associated therewith.

9 Claims, 1 Drawing Sheet

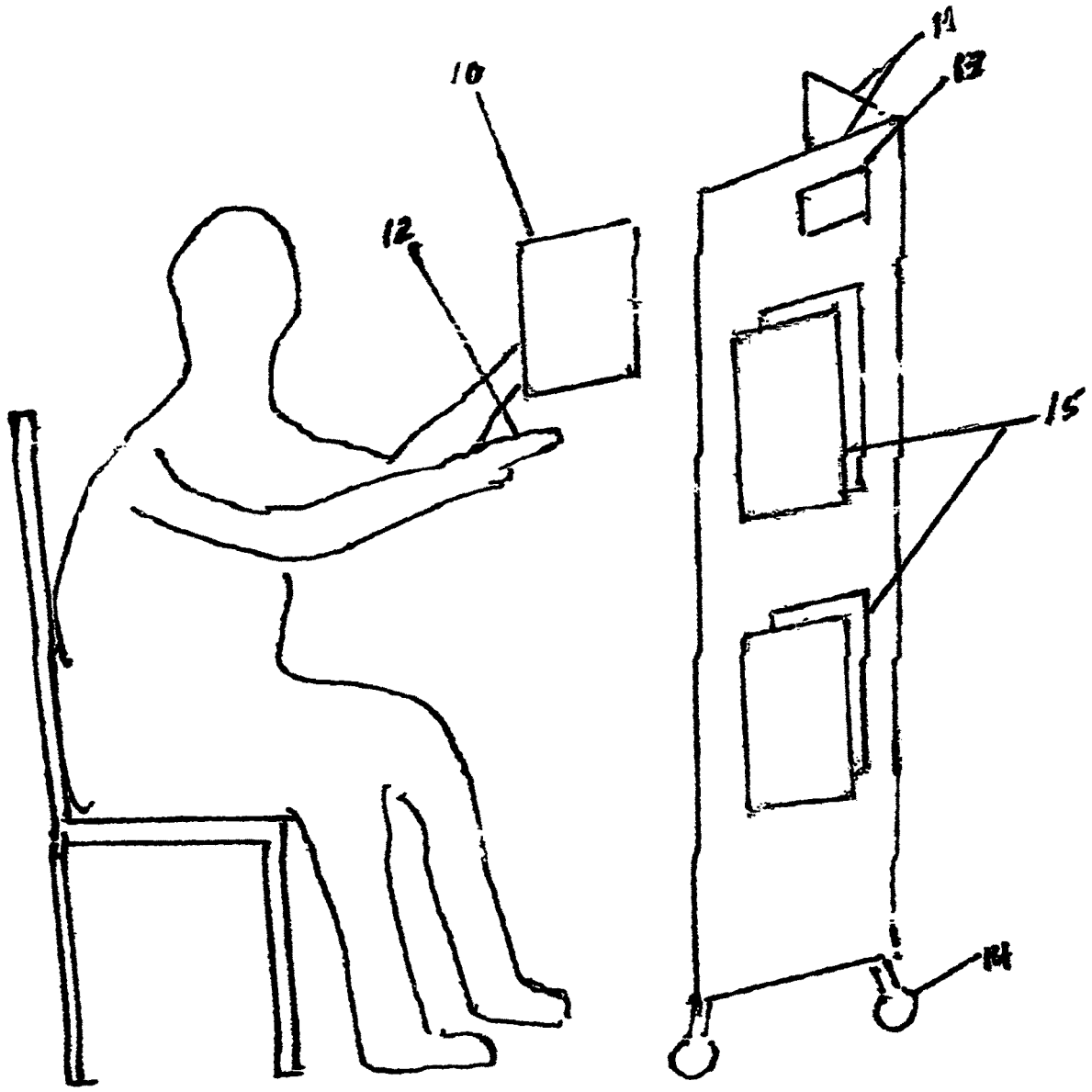
10
12
14
13
15
16

ANTI-TERRORIST THREAT PROTECTION SYSTEM

CROSS-REFERENCE TO RELATED APPLICATIONS

This application claims benefit to provisional U.S. Patent Application 62/665,700, filed May 2, 2018, and hereby incorporates such in its entirety.

BACKGROUND OF THE INVENTION

The rash of shooting in schools, synagogues and other facilities needs immediate solution and except for arming teachers none has been offered so far. Current state of the art solutions for active shooting including clear back packs, bullet-proof back packs, ballistic doors, smoke cannons, resource officers and arming teachers were thought to be impractical, ineffective and/or did not receive wide acceptance. Arming teachers is also risky when the police run in and see one holding a weapon, since the police are liable to shoot that teacher.

BRIEF SUMMARY OF THE INVENTION

The invention is a means of providing defense for intended targets of active shooters and consists of a mobile bullet-proof shelter which is strategically placed close to synagogue pews, teachers' and students' desks or other facility for instant utility access in an emergency. The invention also provides a means of pinpointing the shooting site in a chaotic situation and marking the shooter for law enforcement and disabling the shooter by the use of a non-lethal gun that fires a flaming projectile customarily used in water rescue that kindles his clothing.

Students and synagogue goers leave their bullet-resistant backpacks/vests at the door or in the lockers and have no means of pin-pointing and disabling the shooter. The invention lets the targets crouch behind the mobile, ubiquitous and omnipresent bullet-resistant, angled shelter and with a means of firing with a non-lethal gun with the help of a see-through, clear bullet-resistant glass mounted on the mobile shelter, to pin-point the shooting site for law enforcement as well as mark and disable the shooter with the flaming projectile.

Current and prior art bullet-proof armor vest level III+ can stop a 0.308 round but cannot stop a 30.06. The invention piggy-backs the armor plates and mount them on a stable shelter stand to stop a 30.06 round and even a blast from an improvised explosive device.

The invention improves the intrinsic utility of the prior art non-lethal gun that fires a flaming projectile customarily used for water rescue by using it to signal and pinpoint the location of the active shooting by firing on the window, door or ceiling, and in a chaotic situation, to mark the shooter for law enforcement and at the same time disable the shooter by kindling his clothing.

BRIEF DESCRIPTION OF THE DRAWINGS

The FIGURE shows an embodiment of the invention as deployed.

DETAILED DESCRIPTION

The invention includes two boards of metal or wood measuring from 55 to 71 inches in length, from 14 to 16 inches in width and 2 inches thick, fabricated and joined together on one edge at an angle of 90 degrees with pockets on the outside for embedding bullet-proof armor plates measuring 14.5 inches×12 inches, 6 inches and 15 inches from the top of the 2 boards with a 6 inch×6 inch×1¼ inch clear, bullet-proof, see-through plastic shield, and 4 casters at the bottom for mobility.

LIST OF ELEMENTS

10—Portable hand-held level III+ armor plate;

11—Two panels fabricated of metal or wood joined together on one edge at a 90 degree angle, but foldable in one plane for storage; the outer sides of the panels including pockets;

12—A projectile launching device and a flaming projectile; wherein the launching device is configured to launch a flaming projectile and wherein propellant powder used to launch the projectile is decreased by at least 50% to reduce a maximum trajectory of the projectile;

13—A clear plastic shield installed in the shelter;

14—Casters rendering mobility for the shelter; and,

15—Level III+ armor plate embedded in the pockets or piggy-backed on the panels.

The invention claimed is:

1. An anti-terrorist protection system comprising:

a mobile shelter comprising;

two metal or wooden panels, wherein the panels are joined along one edge of each at a 90 degree angle, wherein the panels can fold together to a collapsed state for storage;

at least one first level III+ armor plate embedded in the shelter; and, a bullet-resistant piece of clear plastic installed in the shelter; and, a projectile launching device and a flaming projectile:

wherein the launching device is configured to launch the flaming projectile, and, wherein propellant powder used to launch the projectile is decreased by at least 50% to reduce a maximum trajectory of the projectile.

2. The system of claim 1, wherein the at least one first level III+ armor plate is a plurality of level III+ armor plates.

3. The system of claim 1, further comprising: a second level III+ armor plate, piggy-backed on the least first level III+ armor plate.

4. The system of claim 1, further comprising: a second level III+ armor plate, wherein the second level III+ armor plate is portable and hand-held.

5. The system of claim 1, further comprising: a plurality of casters for rendering the shelter mobile.

6. An anti-terrorist protection system comprising:

a mobile shelter comprising;

two metal or wooden panels, wherein the panels are joined along one edge of each at a 90 degree angle, wherein the panels can fold together to a collapsed state for storage;

at least two level III+ armor plates piggy-backed on the shelter; and, a bullet-resistant piece of clear plastic installed in the shelter; and, a projectile launching device and a flaming projectile:

wherein the launching device is configured to launch the flaming projectile, and, wherein propellant powder used to launch the projectile is decreased by at least 50% to reduce a maximum trajectory of the projectile.

7. The system of claim 6, further comprising: a third level III+ armor plate.

8. The system of claim 7, wherein the third level III+ armor plate is portable and hand-held.

9. The system of claim 6, further comprising: a plurality of casters for rendering the shelter mobile.

* * * * *